US006867700B2

(12) United States Patent
Jansson

(10) Patent No.: US 6,867,700 B2
(45) Date of Patent: Mar. 15, 2005

(54) SYSTEM AND AN ARRANGEMENT TO DETERMINE THE LEVEL OF HAZARD IN A HAZARDOUS SITUATION

(75) Inventor: Lennart Karl Erik Jansson, Värmdö (SE)

(73) Assignee: Firefly AB, Stockholm (SE)

( * ) Notice: Subject to any disclaimer, the term of this patent is extended or adjusted under 35 U.S.C. 154(b) by 133 days.

(21) Appl. No.: 10/239,762

(22) PCT Filed: Mar. 26, 2001

(86) PCT No.: PCT/SE01/00655

§ 371 (c)(1),
(2), (4) Date: Oct. 24, 2002

(87) PCT Pub. No.: WO01/73716

PCT Pub. Date: Oct. 4, 2001

(65) Prior Publication Data

US 2003/0058103 A1 Mar. 27, 2003

(30) Foreign Application Priority Data

Mar. 28, 2000 (SE) ..... 0001094

(51) Int. Cl.[7] ..... G08B 17/10

(52) U.S. Cl. ..... 340/632; 340/511; 700/9; 702/149

(58) Field of Search ..... 340/511, 517, 340/521, 523, 577, 578; 700/9, 10, 12; 702/149

(56) References Cited

U.S. PATENT DOCUMENTS 4,525,700 A 6/1985 Kimura et al.
5,168,262 A * 12/1992 Okayama ..... 340/523
5,260,687 A 11/1993 Yamauchi et al.
5,670,938 A 9/1997 Ohtani et al.
5,818,326 A * 10/1998 Winterble et al. ..... 340/286.05
5,895,445 A 4/1999 Hong et al.
6,166,647 A * 12/2000 Wong ..... 340/628
6,215,405 B1 * 4/2001 Handley et al. ..... 340/584
6,239,435 B1 * 5/2001 Castleman ..... 250/339.15
6,249,220 B1 * 6/2001 Kaji et al. ..... 340/511
6,320,501 B1 * 11/2001 Tice et al. ..... 340/517
6,346,880 B1 * 2/2002 Schroeder et al. ..... 340/506
6,396,405 B1 * 5/2002 Bernal et al. ..... 340/630
6,420,973 B2 * 7/2002 Acevedo ..... 340/628

FOREIGN PATENT DOCUMENTS

EP 0675468 10/1995

* cited by examiner

*Primary Examiner*—Daniel Wu
*Assistant Examiner*—Samuel J. Walk
(74) *Attorney, Agent, or Firm*—Dykema Gossett PLLC

(57) ABSTRACT

The present invention relates to a system and to an arrangement for evaluating in a defined space or area a delimited area (7) in which there is a degree of urgency greater than the degree of urgency in respect of the remainder of said space (1), wherein there is disposed within said space or area (1) a plurality of sensors which can evaluate the momentary degree of urgency on the basis of one or more criteria. Selected sensors (2, 3, 4) shall be connected to computer equipment (50) which includes storage elements (52, 53, 54) adapted for storing momentary criteria-related values in a chosen time order, and wherein a calculating circuit (51) included in or connected to said computer equipment (50) is adapted for evaluation of a calculated degree of urgency on the basis of time-dependent changes in the evaluated momentary values.

30 Claims, 3 Drawing Sheets

SYSTEM AND AN ARRANGEMENT TO DETERMINE THE LEVEL OF HAZARD IN A HAZARDOUS SITUATION

FIELD OF INVENTION

The present invention relates generally to a system for initially establishing the occurrence of a hazardous situation within a space and, when necessary, calculating the level or degree of urgency of said situation.

Although the present invention is based on the evaluation of different criteria in determining the hazard levels of hazardous situations, the following description mainly deals with only four varying hazard levels, for the sake of simplification, these levels being:

- a first hazard level in which no measures need be taken in respect of the identification of an established hazard;
- a second hazard level in which a noted hazard identification or event shall be monitored or followed-up in order to allow time-related evaluation of the development of said event;
- a third hazard level in which it is advisable to further evaluate the development of said hazard or event and to choose one or more available measures on the basis of this further evaluation; and
- a fourth hazard level in which one or more available measures are called for and activated or set into motion.

The invention also relates to the process of making requisite calculations within the second hazard level.

By "occurring hazard situation" shall be understood an event whose hazard level-related values have been found to have passed the upper limit of the first hazard level, through the medium of measurements, calculations and/or observations, and where the established event and its development shall be placed under special observation through the agency of sensors disposed in said space with a preventative purpose in mind. In this case, development of the hazard situation shall lie beneath the upper limit set for the second hazard level.

By a hazard situation that calls for measures to be set into motion shall be understood that an occurring hazard situation has been monitored over a period of time and that it has been established that said situation has developed towards a higher degree of urgency or higher values of hazard levels that require a decision

- as to whether measures shall be activated, by selecting and activating one or more of a plurality of available measures, whereas development towards a lower hazard level shall obviate the need of activating or setting into motion any of the available measures.

In this case, development of the hazard situation shall lie beneath the upper limit set for the third hazard level.

The measures concerned may comprise ocular superintendence of the event, shutting down evacuation fans, closing fire doors, or the undertaking of correspondingly simple measures.

By hazard situations that call for greater action shall be understood as a measure-calling hazard situation that has been monitored or supervised and one or more measures taken, but where the hazard situation has worsened and therewith requires one or more actions to be instigated immediately.

In this latter case, the values related to development of the hazard situation shall lie above the upper limit of the third hazard level.

As inferred, such actions are of a more comprehensive nature than the simpler measures taken at lower hazard levels and may involve summoning fire defence services, police services and other personnel for a coordinated effort to restrict and fight the event.

By the location of the hazard situation shall be understood, for instance, one or more established and calculated geographical points in a one-dimensional, two-dimensional or three-dimensional co-ordinate system where the calculation is based on a plurality of time-related signals outputted from a plurality of sensors where a monitored hazard situation is concentrated and where a hazardous situation is imminent.

More specifically, the invention relates to a system and to an arrangement for evaluating the development of a hazardous situation within a well-defined space or area with the aid of the introduction of terms such as hazard levels, and in the event of an occurring hazard situation to provide provisions for establishing the geographic position of the hazard situation with the aid of information relating to the development and obtained from a plurality of sensors for detecting mutually the same or mutually different criteria.

A plurality of sensors shall be provided within said space or area adapted for one or more criteria and be capable of evaluating current, or prevailing, values related to hazard levels.

DESCRIPTION OF THE BACKGROUND

Several different kinds of systems and arrangements of the type defined in the introduction are known to the art.

For instance, it is known to supervise tunnels, such as tunnels intended for railtrack vehicles, automotive vehicles, and the like, to distribute TV cameras or sensors, normally one-category sensors, along the length of the tunnel and to supervise ocularly the flow of traffic and any hazard moments and hazard situation that may arise, by one or more operators at a supervising table or monitoring table.

This system is based on the ability of the actual operators to establish that a hazard exists, such as a fire hazard, and themselves determine the level of the hazard and its location and to determine the need for activating one or more of a plurality of available measures or actions.

There have also been proposed a number of different systems for coupling a plurality of sensors to a control unit that includes computer equipment and built-in threshold values, where an alarm signal is initiated and sent from the computer equipment to an operator immediately one of the connected sensors indicates a measurement value or a value related to a hazard level that exceeds a predetermined and current threshold value.

It is also known to explore manually the measure or measures, or the action or actions, that shall be undertaken or carried out in response to information delivered by one and/or more activated sensors.

The most drastic action that can be considered applicable in such a situation is to close the tunnel to traffic, to call the police and fire brigade for relevant action when a single sensor is activated. Such action will cause a train or cars and other vehicles present in the tunnel to be enclosed therein.

Other drastic actions involve stopping a train inside the tunnel and evacuating train passengers through the tunnel, hopefully in the correct direction relative to the ongoing hazard situation.

The complexity of the problem naturally increases when several trains are situated within one and the same tunnel section, and increases still further when a number of railway stations are included within the extension of an underground railway system (subway system).

The last mentioned application should also take into account the air currents that normally exist and the strong, more prevailing air flows or air streams that are generated by movement of a train through the tunnel system.

Earlier known systems and arrangements of the present nature have the drawback of not being able to readily observe the time-wise development of a hazardous situation and the value or magnitude of a current or ongoing hazard level.

SUMMARY OF THE INVENTION

Technical Problems

When taking into consideration the technical deliberations that a person skilled in this particular art must make in order to provide a solution to one or more technical problems that her/she encounters, it will be seen that on the one hand it is necessary initially to realise the measures and/or the sequence of measures that must be undertaken to this end, and on the other hand to realise which means is/are required in solving one or more of said problems. On this basis, it will be evident that the technical problems listed below are highly relevant to the development of the present invention.

When taking into consideration the earlier standpoint of techniques as described above, it will be seen that a technical problem resides in the ability to create, with the aid of relatively simple means, conditions which will enable an occurring hazardous situation to be ascertained or noted at an early stage, and that changes in the noted hazard situation can be continuously established so as to enable increasing hazard level-related values to be detected and attended to long before an initially non-hazardous situation has developed to a dangerous or highly dangerous hazard level.

It will also be seen that in a system and an arrangement in which the development of a hazard situation within a space or an area is evaluated in accordance with hazard level concepts in respect of an occurring hazardous situation, there exists a technical problem in creating conditions for enabling with the aid of information concerning the development of a hazardous situation obtained from a plurality of sensors for the same or for different criteria that will enable the time-wise variation of a hazard level-related output signal from a first sensor and at least the time-wise variation of an output signal from a second sensor to be stored in a memory, wherein a significant change in the variation of the first sensor output caused by the hazardous situation and a significant change in the variation of the second sensor caused by one and the same hazardous situation shall be utilised to determine the value or magnitude of the current hazard level.

It will also be seen that a technical problem resides in the significance of and the advantages afforded by the fact that a comparison between the current values of the output signals and/or the measured time-related changes is able to provide a value of the occurring sensor-related hazard situation, through the medium of a computing or calculating circuit, and choosing solely values that exceed the first hazard level of an indicated hazard situation for following the development of said hazard situation with the aid of said sensor output signals.

It will also be seen that a technical problem resides in realising the significance of and the advantages associated with solely taking into account the calculated hazard levels that exceed a first hazard level and lie beneath a second hazard level.

When said calculated hazard value exceeds a second hazard level although lies beneath a third hazard level, a further technical problem resides in realising the significance of and the advantages associated with taking measures to further evaluate the development of said hazard and/or said event, and choosing to employ accordingly one or more of a plurality of accessible remedial measures.

It will also be seen that a technical problem resides in realising the significance of and the advantages afforded by setting into motion one or more actions from a plurality of available actions when said calculated hazard value exceeds a highest threshold value of a third hazard level.

It will also be seen that a technical problem resides in realising the significance of and the advantages associated with adapting the threshold values of respective hazard levels to chosen criteria and/or to one or more chosen combinations of criteria.

Another technical problem is one of being able to realise the significance of and the advantages associated with allowing the time duration between said significant changes and respective distances between the sensors used to constitute criteria for calculating the hazard level of the hazardous situation.

Still another technical problem is one of realising the significance of and the advantages associated with inhibiting each time-wise and determinable variation beneath the upper limit of a first hazard level while registering and monitoring each time-wise significant change beneath a second hazard level and above said first hazard level, so as to enable the development of the event or hazardous situation to be evaluated.

Another technical problem is resides in realising the significance of and the advantages associated with allowing the chosen thresholds of said hazard levels to be inverted to one or more values for the first time derivative of an established variation.

Another technical problem also resides in realising the significance of and the advantages associated with adapting the threshold values of said hazard levels to the criteria that respective sensors are intended to detect and/or sensor-associated environments.

Yet another technical problem is one of realising the significance of and the advantages associated with allowing further criteria to constitute a measured value of the air flow in a space, with respect to velocity and/or the direction of said air flow and/or the value given by a temperature detecting sensor.

Another technical problem resides in realising the significance of and the advantages associated with allowing said sensors to be adapted to evaluate the concentration of airborne gases, such as CO, $CO_2$ and/or other (nox) gases.

In the case of a system and an arrangement of the kind defined in the introduction, it will be seen that a technical problem resides in realising the significance of and the advantages associated with creating, with the aid of simple means, conditions that enable selected sensors to be coupled to a control unit, such as to computer equipment, where said control unit co-acts with or includes a number of memory devices that function to store sensor output signals in a time-related order as current values, or current criteria values, of the hazard levels, and to allow a calculating circuit included in or connected to said control unit to be adapted for evaluating a calculated hazard level on the basis of time-dependent changes in the established current values.

Still another technical problem is one of realising the significance of and the advantages associated with connecting to said control unit a sensor that functions to determine the direction and velocity of an air flow in said space.

Another technical problem is one of realising the significance of and the advantages associated with connecting to said computer equipment, when applicable, a sensor that functions to evaluate IR radiation.

Still another technical problem is one of realising the significance of and the advantages afforded with connecting to said computer equipment, when applicable, a heat sensor or temperature detector.

Another technical problem is one of realising the significance of and the advantages associated with taking into account and using priority-dependent and weighted measurement values in the computing circuit.

Solution

The present invention is based on a system and on an arrangement for enabling the development of a hazardous situation in a space or in an area to be evaluated with the aid of hazard level concepts and, in the event of a hazardous situation, provide provisions for calculating the level of the hazardous situation on the basis of information relating to the development of said situation and obtained from a plurality of sensors functioning in response to mutually the same or to mutually different criteria.

It is proposed in accordance with the invention that information relating to the time-wise variation in the output signals from a first sensor related to said hazard situation and at least the time-wise variation of similar output signals from a second sensor can be stored and that a comparison is made between the current values of said output signals and/or measured time-related values and a value relating to the occurring hazard situation is produced through the medium of a calculating circuit, and that solely values which exceed a first hazard threshold for an indicated hazard situation are chosen in order to follow the development of the hazard situation through the medium of the sensor output signals.

In accordance with proposed embodiments that lie within the scope of the present invention, it is particularly proposed that said calculated, or computed, hazard level value is chosen to exceed a first hazard level and to lie beneath a second hazard level.

When said calculated hazard value exceeds a second hazard level but lies beneath a third hazard level, measures are taken to evaluate further the development of said hazard and/or event and one or more measures taken from a plurality of available measures is/are put into effect on the basis of this evaluation.

When the calculated hazard value exceeds a highest value of a third hazard level, one or more actions are implemented from a number of available actions.

The threshold values of the hazard levels shall be adapted to chosen criteria and/or to a chosen combination of criteria.

The calculated hazard level can also be made dependent on a change in the variation significant with respect to the hazard situation, and a significant change in the variation of the output signal of the second sensor in respect of one and the same hazard situation, and the time duration between said significant changes and the distance between utilised sensors.

With a starting point from an earlier known system or arrangement, it is now proposed with the intention of solving one or more of the aforesaid technical problems that selected sensors shall be coupled to a control unit, such as to computer equipment, and that said control unit shall include memory devices adapted to allow current criteria-related and hazard level-related values to be stored in a chosen time order, and that a computing circuit, or calculated circuit, included in or coupled to said control unit is adapted to enable a calculated hazard level to be evaluated in accordance with time-dependent changes in the evaluated current or prevailing values.

It is particularly proposed that the calculating circuit shall include priority-dependent and value-weighting means.

Advantages

Those advantages primarily significant to the present invention reside in the provision of conditions for initially establishing and noting a hazard situation and by calculated control of the development of said situation, by utilising the sensor-associated output signal time-wise variation of the current hazard situation to evaluate the time-wise development of the hazard level values and therewith enable a development of a hazard to be followed and an alarm to be given or necessary measures or actions to be taken at an early stage.

BRIEF DESCRIPTION OF THE DRAWINGS

An embodiment of an arrangement which is at present preferred and which has characteristic features significant to the present invention and which functions in accordance with the properties associated with the system will now be described in more detail with reference to the accompanying drawings, in which.

DESCRIPTION OF EMBODIMENTS AT PRESENT PREFERRED

An embodiment significant to the concept of the invention will now be described clearly and succinctly with reference to the accompanying drawings.

It will be understood that the invention can be developed still further and made more complex for more accurate evaluation of different threshold values and calculation of occurring hazard levels, in order to enable one or more different measures or actions available from a plurality of measures or actions to be taken, by using sensors that operate to detect several criteria or by including more sensors.

Figure 1:
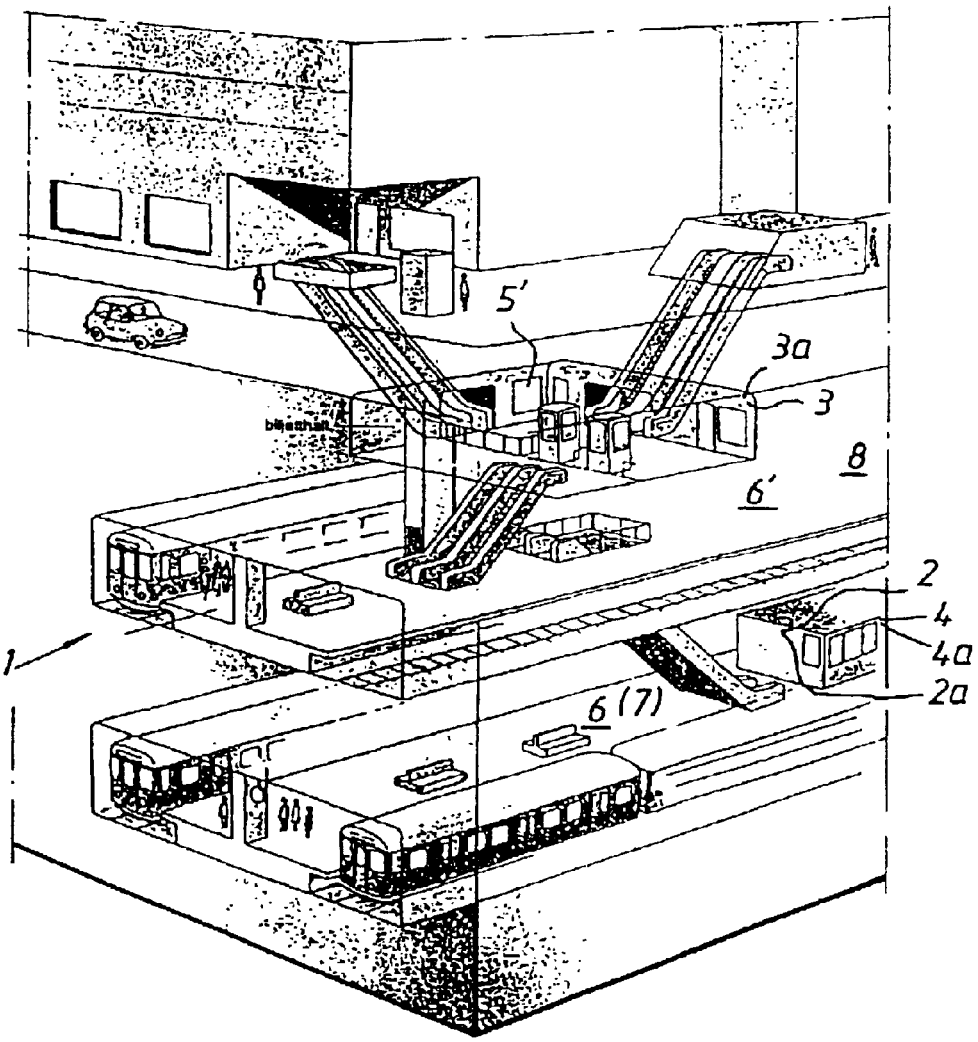
FIG. 1 is a perspective view of a section of an underground railway system which is intended for rail track vehicles and where the invention can be suitably applied.

FIG. 1 is intended to illustrate an underground railway environment, subway environment, in which the present invention can be applied.

The figure shows in perspective a subway section 1 which is monitored by an inventive arrangement.

The invention will be described initially on the basis of solely three sensors 2, 3 and 4 placed at a chosen distance apart in the subway section 1.

Each of the sensors 2, 3 and 4 may be adapted to detect the presence of one or more gases. In the case of the illustrated embodiment, the sensor 2 is adapted to detect and register ongoing or current carbon dioxide values, $CO_2$ values. This also applies to the sensors 3 and 4.

Such sensors 2, 3 and 4 are known to the art and the construction of the sensors forms no part of the present invention, although they constitute a necessary requirement in order for the arrangement to function.

The choice of three sensors for measuring carbon dioxide has been made for reasons of simplicity. It will be obvious that more such sensors may well be used, where each sensor is connected to the control unit and to the computer equipment so as to obtain a better basis on which the hazard level concerned can be judged and calculated, and on which time-wise changes in the hazard level measurement values can be determined.

Further improvements can be attained by using one or more sensors for other criteria.

Figure 2:
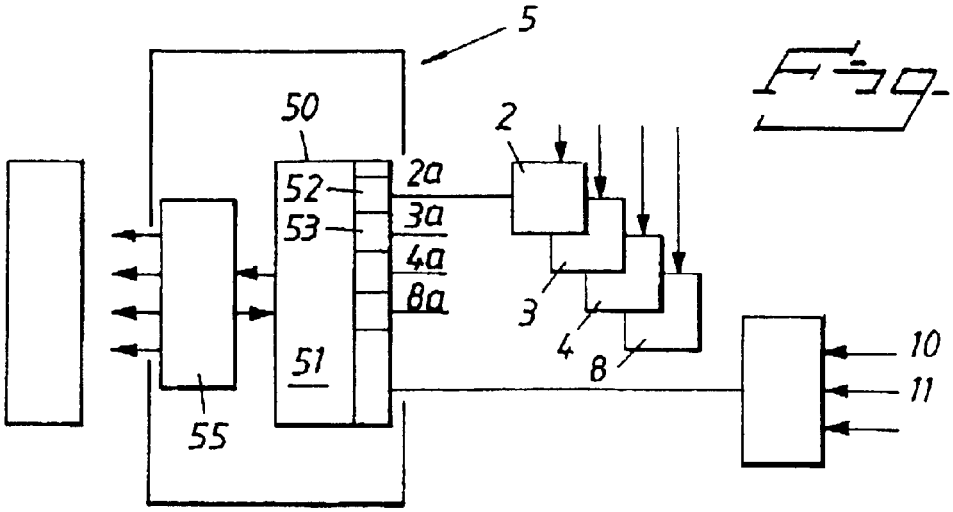
FIG. 2 is a simplified block diagram of a control unit which includes computer equipment with associated storage devices and calculating unit, and to which a plurality of sensors are connected.

The sensors 2, 3 and 4 are connected by known devices 2*a*, 3*a* and 4*a*, either directly or indirectly, to a central control unit 5' which includes computer equipment 5, the nature of which will be described in more detail hereinafter and initially with reference to FIG. 2.

FIG. 1 is based on the assumption that a pronounced hazard situation, reference 6, exists in the illustrated subway section 1, and that this hazard situation is situated at a known distance from the sensors 2, 3, which are shown placed on different floor levels.

The hazard situation 6 is assumed to be a less serious fire in a wastepaper basket situated in a delimited area 7.

Figure 3:
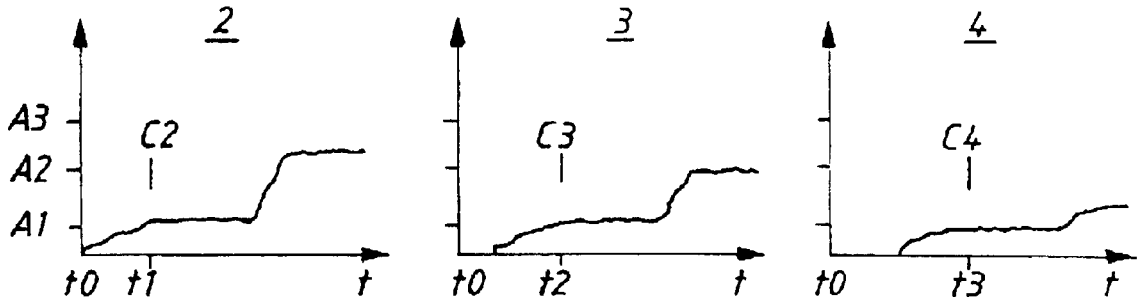
FIG. 3 illustrates by way of example three separate time-wise changes in an output signal related to a hazard level, based on hazard level measurement values obtained from three (a plurality) sensors.

The hazard situation 6 is now detected by the sensors 2, 3 within the time periods t0–t1 in FIG. 3. However, the detected and subsequently calculated values are so low, lying beneath a first hazard level Al, that neither the system nor the arrangement reacts, wherewith these indications are inhibited.

The invention is based on the concept of keeping a hazard situation under special observation or supervision should the hazard situation 6 develop so that the hazard level values given by the sensors 2 and 3 increase to the calculated hazard values between the hazard levels A1 and A2.

The time-wise development of the fire 6 therewith becomes significant.

If the fire or hazard situation 6 develops to values above A2 but beneath A3, this will be observed by the computer equipment 5 and a calculation will be made in said computer in accordance with given mathematical formulae and/or a comparison will be made with stored and empirically obtained predetermined values, wherewith one or more measures from a plurality of available measures will be activated in accordance with the hazard levels and/or the time-wise changes in the values, its first derivative with respect to time, or other criteria.

One measure may be to illuminate a warning lamp in the control room, while another measure may be to summon personnel for ocular inspection of the situation.

Different actions are put into motion should the calculated values of the detected hazard level exceed the value for A3.

This action may involve activation of a sprinkler system in the region of the hazard situation 6. Another action may involve stopping a train at an upline station. Another action may involve stopping the train in the subway section before the station has been reached and request evacuated passengers to walk back along the tracks.

Hazard level values above the hazard level A3 constitute an indication that measures and significant actions of catastrophe nature must be undertaken immediately.

The invention relates to a system and arrangement for evaluating the development of a hazard situation within a space or within area with the aid of hazard level conceptions, said hazard levels having the definition mentioned in the introduction, and, in the event of a prevailing hazard situation, the creation of conditions for determining the level of the hazard situation with the aid of information relating to the development of said situation and obtained from a number of sensors for mutually the same or mutually different criteria.

In order to be taken into account, the estimated hazard value shall exceed a first hazard level and lie beneath a second hazard level.

When the calculated hazard values exceed a second hazard level or lie beneath a third hazard level, measures are taken to further evaluate the development of the hazard and/or the event and one or more measures from a plurality of available measures is/are undertaken in accordance with the result of said further evaluation.

When the calculated hazard values exceed a chosen threshold value for a third hazard level, a choice of one or more actions of a plurality of available actions is taken.

The threshold values of the hazard levels shall be adapted to a chosen criterion and/or to one or more combinations of criteria chosen from a plurality of available criteria.

The calculated hazard level may be dependent on a significant change in the variation of the output signal of the first sensor caused by the hazard situation, or a change in the variation of the output signal of the second sensor caused by the same hazard situation, for the time duration between said significant changes and the distance between used sensors.

The threshold values of said hazard levels can be altered and may be adjusted to the inverse of a value of the first time derivative of the variation.

The hazard level threshold values may also be adjustable to the choice of sensor-detecting criterion and/or the sensor environment.

The invention also relates to an arrangement for calculating the location of or the co-ordinates of a developed fire 6 occurring in a defined space or an area 7 situated in the subway extension 1, and for evaluating and indicating a restricted area 7 in which an occurring hazard level exceeds the hazard level in respect of the remainder of the space 1, through the medium of a co-ordinate calculation.

Thus, a plurality of sensors that function to detect one or more criteria and that evaluate the values of current or ongoing hazard levels.

The sensors 2, 3 and 4 function to detect the presence of carbon dioxide, while a sensor 8 functions to detect the velocity and direction of the air flow.

A plurality of air flow detecting sensors 8 are required in an environment such as a subway environment 1, so as to enable temporary increases in the air flows caused by moving trains, and lesser air flows for the ventilation system, can be observed for the purpose of improving the reliability of the invention.

The velocity and magnitude of the air flows, or air streams, can be entered into the computer equipment 5 as a monitoring criterion.

In addition, measurements made by a sensor may be ignored during the short time interval during which train-generated turbulence exists, when such turbulence is judged not to have a detrimental effect on the measurement result.

There is also proposed the use of a computing or calculating circuit 51 belonging to a control unit or to computer equipment, for evaluating the current hazard level in addition to said hazard level-related value in accordance with a number of current hazard level-related measurement values registered time-wise and obtained from said sensors 2, 3 and 4, and also to establish the local orientation of the limited area 7.

According to the invention, the control circuit 5' includes a coupling to a number of selected sensors 2, 3, 4, where all of the sensors shall be coupled to the input terminals of a computer equipment 50.

The invention is based on the principle that in the case of a space in which there is absolutely no wind, the gases (carbon dioxide) generated by the fire 6 will spread evenly and at the same rate towards the sensor 2, the sensor 3 and the sensor 4, which enables the change in gas concentration to be recorded and sampled time-wise.

FIG. 3 is intended to illustrate a measured time-wise displacement of significant changes in the hazard level-related values and to calculate therefrom the hazard level values in respect of the sensors 2, 3 and 4.

FIG. 3 shows that one such change C2, C3 and C4 from one and the same hazard situation in respect of the sensor 2 has been recorded at time point t1, and in respect of sensor 3 at time point t2, and in respect of sensor 4 at time point t3.

In practice, the air flow conditions, or wind conditions will, of course, change in the space and cause the gases to be distributed towards the sensors 2, 3 and 4 in another, more complicated pattern, although all this can be stored in the computer equipment 50.

The gases generated by the fire 6 can also spread up through the escalator stairway to an upper floor level and to the sensor 3, which is also able to record time-wise the ongoing values of the gas concentration and also to establish changes "C3" in said values.

The more sensors used, the greater the precision obtained with respect to the value of a calculated hazard level. Consequently, many sensors shall be used in practical applications.

One significant requirement in calculating the hazard level lies in the provision of adequate information relating to prevailing air flows or air movements in said space or area around said sensors, both with respect to the direction and the speed of said air flows.

To this end, the computer equipment 50 may include, or at least have access to, a number of storage devices 52, 53 and 54 which are each adapted to store current hazard-level-related measurement values obtained through the sensor output signals, in a chosen time sequence.

There is nothing to prevent the use of mean values as criteria-related values.

A calculating circuit 51 included in or coupled to the computer equipment 50 is primarily adapted to evaluate and calculate hazard level values on the basis of the absolute values and/or time-dependent changes in the current measurement values evaluated from two or more sensors 2, 3, 4.

Figure 6:
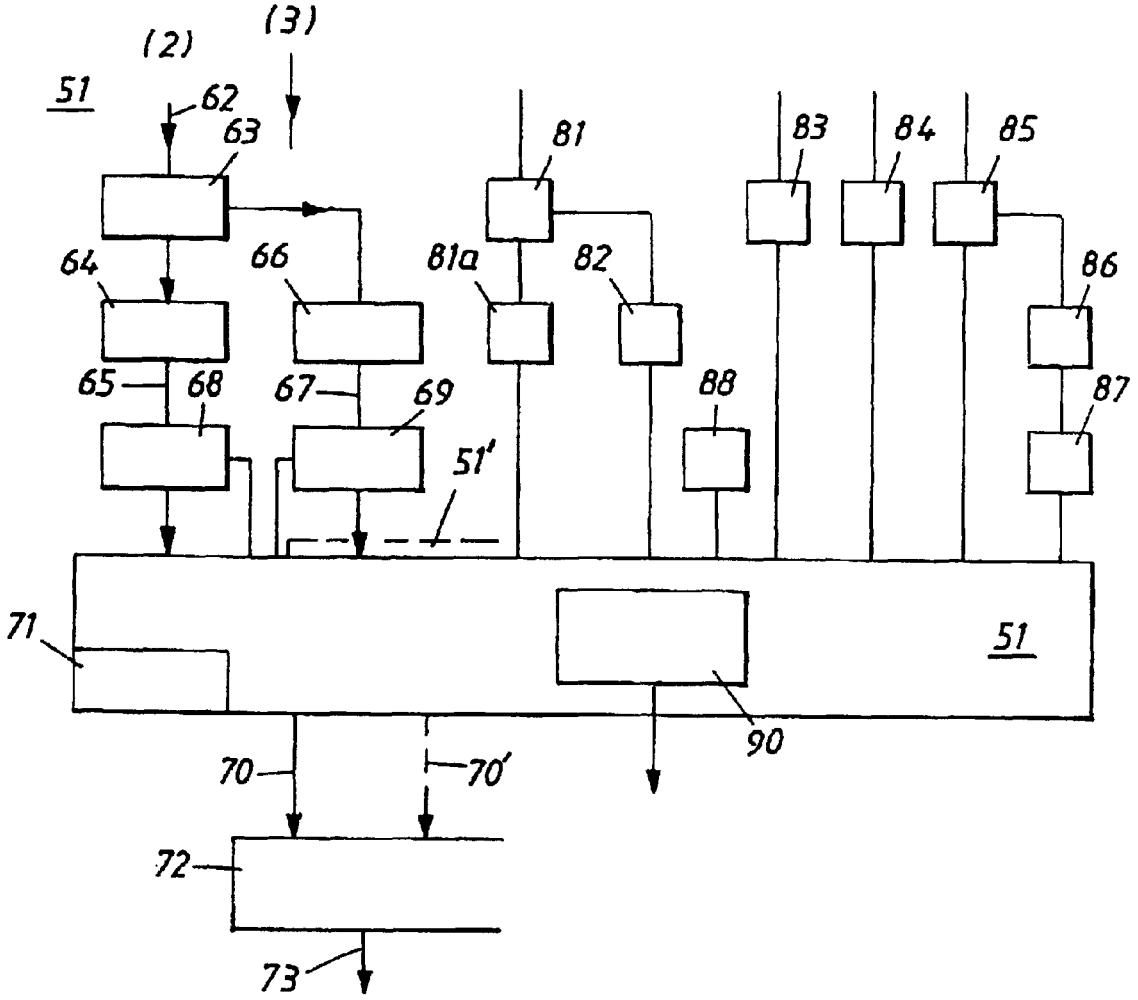
FIG. 6 illustrates an application adapted for computer equipment.

FIG. 6 shows the sensor 2 connected to the calculating circuit 51, and the sensor 3 connected to a calculating circuit 51', and so on.

The calculating circuit 51 is also adapted to enable the locality of the limited area 7 to be determined and established by, inter alia, considering time shifts between evaluated values from said sensors 2, 3.

More particularly, it is conceivable in an ideal case that (nox) gases generated by an initially small fire 6 in the absence of significant air flows in the subway section will spread towards the sensors 2, 3 and the computer equipment 5 including the calculating circuit 51 at mutually the same speed, wherewith each sensor 2 and 3 is able to determine an equivalent increase in the evaluated measurement values.

When the limited area 7 is situated midway between the sensors 2, 3, detection and evaluation will give similar contributions at the same point in time (not shown in FIG. 3).

If the limited area 6' is situated somewhat closer to or immediately adjacent a sensor, for instance the sensor 3, the increase and intensity of the situation will increase much more quickly at the sensor 3 than at the other sensor 2.

The rate of increase shall primarily be considered as a measurement of the hazard level of the hazard situation, thereby enabling the first derivative to be used as a measurement of the degree of urgency.

The computer equipment 50 may be designed to evaluate the degree of urgency of the incident on the basis of said intensity and/or in the first instance on the time-wise increase of said intensity, and indicate the measures that shall be taken at that time, through the medium of a circuit 55. As the value increases, there are indicated other measures that require quicker action and the undertaking of more serious measures.

According to the present invention, at least one sensor 8 adapted to establish the direction and speed of the air flow within the space shall be connected 8*a* to said computer equipment 50, so that the calculating circuit 51 is able to take the effect of these air currents or air flows into account.

This sensor 8 enables the computer equipment 50 to be provided with requisite information concerning certain increases in air flow, for instance increases that can be caused by a passing train.

This circumstance may indicate that the computer equipment 50 shall not take into account any rapid changes, such as a significant drop, in the measurement values that can be expected to occur over a short period of time during said rapid increase in the air flow and for a given time thereafter.

However, the measurement values from the sensors 2, 3 and 4 shall be evaluated (immediately) thereafter, so as to establish whether there is an increase or a decrease in the measurement values, and in the event of a positive increase the computer equipment 50 and its calculating circuit 51 shall choose to put an even quicker action and an even greater measure into effect through the medium of said circuit 55.

This action (measure) may involve stopping a train immediately and evacuating passengers in a direction away from the location of the incident.

According to the invention, at least one sensor designed to evaluate one or more significant (nox, noxious) gases shall be connected to the computer equipment.

In addition, at least one sensor 10 adapted to evaluate IR radiation may be connected to said computer equipment 50. Signals from this sensor may be allocated a higher priority and/or weighted against the values of other sensors, so as to obtain a more reliable choice of the measure or measures that must be taken.

It is particularly proposed that at least one heat sensor or temperature indicator 11 is connected to the computer equipment 50. The output value of this latter sensor may also be weighted higher than the values of the other sensors 2, 3 when calculating the prevailing degree of urgency or hazard level, and the choice of appropriate measures.

The calculating circuit 51 or the computer equipment 50 in particular will include priority-dependent and value-weighting devices that indicate that particular attention shall be taken to the output signal of certain sensors and the evaluated values relating to the degree of urgency.

The person skilled within this technical field will be aware from the described exemplifying embodiment, of the different alternative modifications that can be made without necessarily departing from the concept of the invention, these modifications also being considered a part of the present invention even though they have not been described and explained in detail.

Figure 4:
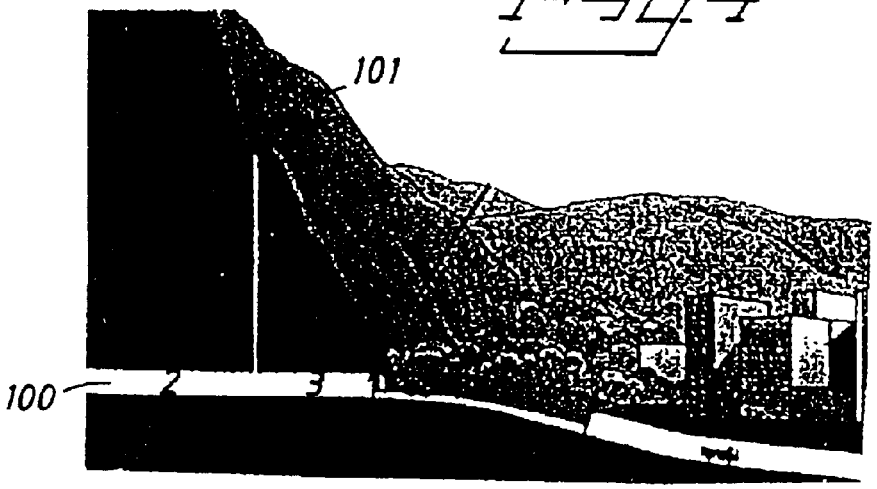
FIG. 4 illustrates a more general application of the invention in a section of a tunnel intended for automotive vehicles.
Figure 5:
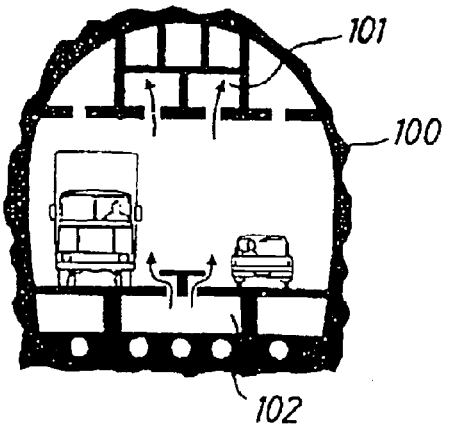
FIG. 5 is a cross-sectional view of the tunnel section shown in FIG. 4.

FIGS. 4 and 5 illustrate a more general application in a tunnel 100, where the sensors 2 and 3 are each located on a respective side of a tunnel ventilation duct 101.

FIG. 5 is a cross-sectional view of the tunnel 100 and shows the ventilation duct 101, a fresh air intake 102 and vehicular traffic in the tunnel.

The sensors used may be placed high up or low down in the tunnel.

In addition to the aforedescribed applications, the invention can also be applied in underground mining shafts for detecting and localising the presence of toxic gas and gas flows, in monitoring fires and/or the presence of people in buildings, office premises, workshops, and so on.

More specifically, the invention relates to a system and to an arrangement for evaluating the development of a hazard situation in a space or in an area with the aid of hazard level concepts and to create conditions in the event of an occurring hazard situation for enabling the geographic location of the hazardous situation to be determined with the aid of information relating to the development of said situation obtained from a plurality of sensors for detecting mutually the same criterion or mutually different criteria.

A significant feature of the present invention resides in the particular design of the calculating circuit 51 and the manner in which it is adapted to evaluate and to calculate a hazard level, said calculated hazard level differing from the hazard-level-related value delivered by activated sensors.

A number of output signals from activated sensors shall be delivered to the calculating circuit 51 and, in order to simplify the description, only output signals from the sensor 2 will be described. These signals may conveniently be coordinated with other output signals from other sensors 3.

Output signals from other sensors, such as 3 and 4, may also be coordinated with output signals from other sensors.

Hazard level-related output signals from the sensor 2 are delivered continuously to a memory 63 via a line 62. Current values can now be taken from the memory store via a circuit 64, these values being outputted on a line 65.

A circuit 66 is adapted for evaluation of the first derivative of the received curve form, the value of this derivative appearing on a line 67.

Calculated hazard level-related values on the lines 65 and 67 may be the subject of a weighting process in units 68, 69, where a high signal on the line 67 may be weighted to a greater extent than signals on the line 68 in certain applications.

Each such weighting process may conveniently be effected through the medium of circuits in the calculating unit 51.

It will be noted in this respect that a hazard level chosen by calculation on a line 70 may be changed by the evaluation of the calculating circuit 51 so as to enable the value of a hazard level, such as the hazard level A2, to be lowered when the value of the first derivative of the curve form increases.

A threshold setting circuit 71 is thus not solely influenced by the curve form 64 applicable at that moment in time or the first derivative 66 of said curve form, but also by the choice of sensor detecting criteria where a current or immediate value 81, a rectified current value 81*a* and/or a detected rise in temperature 82 shall be given a higher priority than an increase in the carbon dioxide concentration, through the medium of the sensor 2.

Other criteria that must be considered in tunnel applications include the magnitude and the direction of air flows and air currents in said space, which is effected in a circuit 83.

A factor that is dependent on the prevailing environment of the sensor 2 may be inserted through the medium of a circuit 84. In the case of a fire monitoring operation, this factor will have a lower value in the case of a moist environment than for a drier or an explosive environment.

In the case of temporary transportation of hazardous goods through a tunnel, it may be advisable to significantly reduce or lower the hazard level threshold values during transportation of the goods.

A circuit 85 that detects current temperature values and a circuit 86 for calculating the first derivative of temperature differences may also be connected to the calculating circuit 51 via weighted values in a unit 87. IR sensors may also be used.

Moreover, there may be entered into a memory store 88 sensor-detected variations deriving from a test in which a given gas is released from a chosen site or position and where the distribution rate, distribution values and the time-wise change in gas concentration are registered in said memory store as standard. Many such points may be evaluated so as to obtain a distribution pattern that can be stored in a memory.

It is also proposed that the distribution pattern of other gases is registered in the memory as standard.

In accordance with the invention, it is also proposed that corresponding circuits shall be used for the remaining sensors 3 and 4. A calculation circuit 51' has been shown in respect of the sensor 3, with an output signal on the line 70'.

The measurement values obtained from the calculating circuits of each sensor and the time delay where significant changes can be noted, can now be used to determine the geographical location of the hazard situation.

FIG. 6 shows that a hazard level value 70 calculated in the calculating circuit 51 for the sensor 2 and the corresponding hazard level 70' for the sensor 3, and so on, shall be coordinated in a circuit 72 so as to provide by further calculation a hazard level value 73 which observes all measurement values, their changes in time, and different selected criteria.

The geographical location of the hazard situation can now be calculated in the calculating unit 51.

The time points t1, t2, t3 at which one and the same significant change occurs in the various sensors are entered into a circuit 90. The circuit 90 includes information relating to the spacing between said time points, information concerning prevailing wind or air speed and direction, and other information required for calculating the geographical position of the hazard situation.

On the basis of such information and also on the basis of one or more pieces of information required to evaluate the hazard level value, it is possible to establish the location of the event at least roughly.

It will be understood that the invention is not restricted to the aforedescribed and illustrated exemplifying embodiments thereof and that modifications can be made within the concept of the invention as illustrated in the accompanying claims.

What is claimed is:

1. A method for evaluating the development of a hazard situation within a space or an area with the aid of hazard level concepts and, upon the occurrence of a hazard situation, creating conditions whereby the hazard level of the hazard situation can be obtained on the basis of information relating to development of said hazard situation deriving from a plurality of sensors that function in respect of mutually the same or mutually different criteria, wherein information relating to a time-wise variation of output signals related to the hazard situation and obtained from a first sensor and also relating to a time-wise variation of similar output signals obtained from a second sensor can be stored; a comparison between momentary values of the output signals and/or measured time-related changes generate a hazard level value for the occurring hazard situation through the medium of a calculating circuit; and solely the hazard level values that exceed a first hazard level of an indicated hazard situation are chosen to follow the development of the hazard situation by means of the output signals from said sensors, wherein the calculated hazard level is dependent on a significant change in the variation of the output signal of the first sensor in respect of the hazard situation, a significant change in the variation of the output signal of the second sensor in respect of the same hazard situation, the time duration between said significant changes, and the distance between used sensors.

2. A method according to claim 1, wherein said calculated hazard level value is chosen to exceed the first hazard level and to lie beneath a second hazard level.

3. A method according to claim 2, wherein when said calculated hazard level value exceeds the second hazard level and lies beneath a third hazard level, the development of the hazard and/or the event is further evaluated and one or more measures is/are taken from a plurality of available measures on the basis of this evaluation.

4. A method according to claim 3, wherein when said calculated hazard level value exceeds a highest value of said third hazard level one or more actions is/are taken from a number of available actions.

5. A method according to claim 1, wherein threshold values of said hazard levels are adapted in respect of chosen criteria and/or a chosen combination of criteria.

6. A method according to claim 1, wherein the time-wise variation of each output signal in the first hazard level is inhibited, while each time-wise significant change in a second hazard level and above said first hazard level is registered and monitored or supervised to allow the development of the event or the hazard situation to be determined.

7. A method according to claim 1, wherein threshold values of said hazard levels can be adjusted inversely to a value of a first time derivative of the variation.

8. A method according to claim 1, wherein threshold values of said hazard levels can be adjusted to a choice of sensor-detecting criterion and/or sensor-associated environments.

9. A method according to claim 8, wherein one criterion is the value or magnitude of the air flow in a space with respect to the speed and/or direction of said air flow and/or a temperature-detecting sensor.

10. A method according to claim 1, wherein said sensors evaluate the concentration of airborne gases, such as CO, $CO_2$ and/or other gases.

11. A method according to claim 1, wherein selected sensors shall be connected to a control unit, such as computer equipment; said control unit shall include and/or co-act with memory devices adapted for the storage of sensor-associated outputted criteria-related momentary values in a selected time order; and the control unit includes and/or has connected thereto a calculating circuit which functions to allow a calculated hazard level value to be evaluated on the basis of time-dependent changes in the evaluated sensor associated momentary values.

12. A method according to claim 11, wherein at least one sensor evaluates the direction and speed of the air flow in said space and is connected to said control unit.

13. A method according to claim 11, wherein at least one sensor determines the presence of IR radiation and is connected to said control unit.

14. A method according to claim 11, wherein at least one heat sensor or temperature indicator is connected to said control unit.

15. A method according to claim 1, wherein said values are the subject of calculation with the use of priority-dependent and value-weighting means.

16. An arrangement for evaluating the development of a hazard situation within a space or within an area with the aid of hazard level concepts, and for creating in the event of an occurring hazard situation conditions which enable a hazard level of said hazard situation to be determined on the basis of information concerning the development of said hazard situation and obtained from a plurality of sensors in respect of mutually the same or mutually different criteria, information obtained concerning a time-wise variation of similar output signals from a second sensor are storable in a memory; wherein a comparison between momentary values of said output signals and/or measured time-related changes generate through the medium of a calculated circuit a hazard level value for the occurring hazard situation; and wherein solely the values that exceed a first hazard level of an indicated hazard situation are chosen in following the development of the hazard situation with the aid of the sensor output signals, wherein a calculated hazard level value consists of a significant change in the variation of the output signal from the first sensor caused by said hazard situation, and a significant change in the variation of the output signal of the second sensor caused by the same hazard situation, wherein said hazard level value can be evaluated with the aid of means that take into consideration the time duration between said significant changes and the distance between used sensors.

17. An arrangement according to claim 16, wherein said calculated hazard level value can be chosen to exceed a first hazard level and to lie beneath a second hazard level.

18. An arrangement according to claim 16, wherein measures are taken to further evaluate the development of the hazard and/or the event when said calculated hazard level exceeds a second hazard level and lies beneath a third hazard level and one or more measures of a number of available measures is/are taken on the basis of this further evaluation.

19. An arrangement according to claim 16, wherein one or more actions of a number of available actions is/are taken when said hazard level value exceeds a highest value of a third hazard level.

20. An arrangement according to claim 16, wherein threshold values of the hazard levels are adapted with respect to chosen criteria and/or chosen combination of criteria.

21. An arrangement according to claim 16, wherein each time-wise variation of the output signal in a first hazard level can be inhibited via means functioning to this end, while each time-wise significant change in a second hazard level that lies above said first hazard level can be registered and monitored in means functioning to this end, so as to enable the development of the event or hazard situation to be evaluated.

22. An arrangement according to claim 16, including means for inverting the threshold values of said hazard levels to the value of the first time derivative of the variation.

23. An arrangement according to claim 16, including means for adapting threshold values of said hazard levels to the choice of sensor-detecting criteria and/or the sensor-associated environment.

24. An arrangement according to claim 16, wherein a further criterion is the monetary value of the speed an/or a temperature-detecting sensor.

25. An arrangement according to claim 16, wherein said sensors are adapted to evaluate the concentration of gases in the air, such as CO, $CO_2$ and/or other gases.

26. An arrangement according to claim 23, wherein said means include the connection of selected sensors to a control unit, such as computer equipment; said control unit includes and/or co-acts with memory means adapted for the storage of sensor-associated momentary criteria-related values in a chosen time order; and a calculating unit which is included in or connected to said control unit is adapted for the evaluation of a calculated hazard level value on the basis of time-dependent changes in the evaluated momentary values.

27. An arrangement according to claim 26, wherein at least one sensor adapted for determining direction and speed of the air flow in said space is connected to said control unit.

28. An arrangement according to claim 16, wherein at least one sensor adapted for evaluating IR radiation is connected to said control unit.

29. An arrangement according to claim 28, wherein each heat sensor or temperature indicator is connected to said control unit.

30. An arrangement according to claim 16, wherein the calculating circuit includes priority-dependent and/or value-weighting means.

* * * * *